US005402547A

United States Patent [19]

Theurer

[11] Patent Number: 5,402,547

[45] Date of Patent: Apr. 4, 1995

[54] BALLAST BROOM

[75] Inventor: Josef Theurer, Vienna, Austria

[73] Assignee: Franz Plasser Bahnbaumaschinen-Industriegesellschaft m.b.H., Vienna, Austria

[21] Appl. No.: 260,000

[22] Filed: Jun. 15, 1994

[30] Foreign Application Priority Data

Jul. 8, 1993 [AT] Austria ..... A1344/93

[51] Int. Cl.[6] ..... E01H 8/00

[52] U.S. Cl. ..... 15/55; 104/279; 137/104; 137/210; 171/16

[58] Field of Search ..... 15/55; 37/104, 105, 37/209, 210; 171/16; 104/279

[56] References Cited

U.S. PATENT DOCUMENTS

| | | | |
|---|---|---|---|
| 2,869,159 | 1/1959 | Kershaw | 15/55 |
| 3,426,379 | 2/1969 | Holley et al. | 15/55 |
| 4,554,697 | 11/1985 | Coy et al. | 15/55 |
| 4,706,395 | 11/1987 | Cicin-Sain | 37/105 |
| 5,097,608 | 3/1992 | Theurer | 37/104 |

FOREIGN PATENT DOCUMENTS 56-5001 1/1981 Japan .

1040104 8/1966 United Kingdom .

*Primary Examiner*—Edward L. Roberts, Jr.
*Attorney, Agent, or Firm*—Collard & Roe

[57] ABSTRACT

A ballast broom machine for sweeping ballast off a track comprises an elongated machine frame supported on the track by undercarriages, and at least three ballast brooms vertically adjustably mounted on the machine frame, the ballast brooms being spaced from each other in the longitudinal direction and including a leading ballast broom, each ballast broom comprising a rotary shaft extending perpendicularly to the longitudinal direction and flexible sweeping elements projecting radially from the rotary shaft. A conveyor band is mounted on the machine frame and extends in the longitudinal direction, the conveyor band having an input end arranged to receive ballast swept off the track by the leading ballast broom and a discharge end positioned higher than the input end, and a ballast storage bin having discharge openings is arranged on the machine frame below the conveyor band discharge end for receiving discharged ballast therefrom. A ballast conveyor band is mounted on the machine frame immediately preceding each ballast broom and extends transversely to the longitudinal direction.

11 Claims, 2 Drawing Sheets

BALLAST BROOM

BACKGROUND OF THE INVENTION

1. Field of the Invention

The present invention relates to a ballast broom machine for sweeping ballast off a track, which comprises an elongated machine frame extending in a longitudinal direction and supported on the track by undercarriages for moving the machine frame in an operating direction, and a plurality of ballast brooms vertically adjustably mounted on the machine frame, the ballast brooms being spaced from each other in the longitudinal direction, each ballast broom comprising a rotary shaft extending perpendicularly to the longitudinal direction and flexible sweeping elements projecting radially from the rotary shaft.

2. Description of the Prior Art

A ballast broom machine of this type has been disclosed in U.S. Pat. No. 4,554,697, dated Nov. 26, 1985, in which one ballast broom is mounted immediately ahead of the front undercarriage and another ballast broom is mounted immediately behind the rear undercarriage. Each broom is provided with a leading deflector box arranged to move excess ballast from the center of the track to the shoulder. This machine is not capable of sweeping substantial amounts of ballast off the track.

Japanese utility model application disclosure No. 5001/81, published Jan. 17, 1981, discloses a small ballast broom machine comprising a machine frame supported on the track by two undercarriages wherebetween a ballast broom unit is vertically adjustably mounted. The ballast broom unit carries two brooms which may be used selectively or together. This machine, too, is not capable of removing substantial amounts of ballast from the track.

British patent No. 1,040,104, published Aug. 24, 1966, deals with a machine for the compaction of ballast in railroad track cribs. Three ballast brooms precede the ballast compactors in the operating direction, one of the brooms having a rotory shaft extending transversely to the longitudinal direction of the machine frame while the rotary shafts of the two other ballast brooms extend in the longitudinal direction. The two last-named brooms may be immersed in the ballast in the cribs to make it possible to sweep more ballast out of the cribs.

Finally, U.S. Pat. No. 5,097,608, dated Mar. 24, 1992, deals with a ballast regulator with a ballast plow and a vertically adjustable ballast broom at the rear end of the machine frame. This ballast broom has a rotary shaft extending transversely to the longitudinal direction in which the machine frame extends and a tranversely extending conveyor band precedes the ballast broom to remove swept-up excess ballast to the track shoulder. Two additional ballast brooms are arranged between the plowshares of the ballast plow to assist in the distribution of the plowed ballast between the track shoulders at an angle to the longitudinal direction.

SUMMARY OF THE INVENTION

It is the primary object of this invention to provide a ballast broom machine of the first-described type which not only efficiently sweeps accumulated ballast off the track but also assures a uniform ballasting of the track.

This and other objects are accomplished according to the invention with a ballast broom machine which comprises at least three ballast brooms vertically adjustably mounted on the machine frame, the ballast brooms being spaced from each other in the longitudinal direction and including a leading ballast broom in the operating direction, and each ballast broom comprising a rotary shaft extending perpendicularly to the longitudinal direction and flexible sweeping elements projecting radially from the rotary shaft. The machine further comprises a conveyor band mounted on the machine frame and extending in the longitudinal direction, the conveyor band having an input end arranged to receive ballast swept off the track by the leading ballast broom and a discharge end positioned higher than the input end, a ballast storage bin having discharge opening means and being arranged on the machine frame below the conveyor band discharge end for receiving discharged ballast therefrom, and a ballast conveyor band mounted on the machine frame immediately preceding each one of the ballast brooms and extending transversely to the longitudinal direction.

This combination of structural features has not only the effect of producing optimal efficiency in the ballast sweeping operation but also makes it possible, if required, to distribute excess ballast from one section of the track to another track section which does not have enough ballast. This is made possible primarily by associating a ballast storage bin with the leading ballast broom which feeds the bin. Furthermore, ballast brooms with differently shaped rotary bodies formed by the end faces of the flexible sweeping elements can be used in such a machine to adapt it to the operation in different track sections, for example sections with wooden ties and sections with concrete ties, without the need for retrofitting and simply by using the broom adapted for operation in the revailing track section.

If a respective linkage, preferably a parallelogram linkage, connects each one of the ballast brooms to the machine frame for movement of the ballast brooms in all directions, and flanged wheels support each one of the ballast brooms on the track, the ballast brooms may be vertically positioned accurately relative to the upper edges of the track ties so that it is possible to stagger the vertical position of the successively arranged ballast brooms. This will avoid excessive wear of the flexbile sweeping elements of the leading ballast broom, particularly if the machine advances at high speed, and also makes it possible accurately to adjust the level of the ballast relative to the upper edges of the ties. A parallelogram linkage assures a vertical adjustment of the ballast broom while maintaining the horizontal position of the transversely extending conveyor band which forms a unit with the ballast broom.

Thus, a ballast broom machine incorporating this combination of structural features is particularly useful for maintenance work in high-speed track sections which require a relatively extensive lowering of the ballast level while keeping the ballast distribution as uniform as possible. In addition, such maintenance work requires a high efficiency in the ballast sweeping operation because usually only short work periods are available between passing trains.

According to a preferred feature of the present invention, the machine frame is comprised of a leading frame part and a trailing frame part in the operating direction, the two frame parts being pivotally coupled together by a joint, and one of the undercarriages is arranged to support the leading frame part and the trailing frame part at this joint. This assures that, even when operating the machine in sharp curves, the ballast brooms will not be unduly displaced laterally relative to the machine frame.

According to a preferred embodiment of this invention, the two ballast brooms trailing the leading ballast broom are mounted at a rear end of the trailing frame part in the operating direction, one of the undercarriages is arranged to support the rear end on the track, the joint pivotally couples a forward end of the trailing frame part to a rear end of the leading frame part in the operating direction, the leading frame part rear end projecting beyond another one of the undercarriages supporting the leading frame part on the track, the forward end of the trailing frame part and the rear end of the leading frame part forming an upwardly recessed machine frame section receiving the leading ballast broom. This arrangement makes it possible to use existing ballast regulators with a ballast broom mounted in an upwardly recessed machine frame section in the ballast broom machine, with a minimum of retrofitting.

If the machine further comprises a ballast planing shield preceding the leading ballast broom in the operating direction and vertically adjustably mounted on the machine frame, ballast accumulations will be reduced so that the ballast sweeping effect will be uniform and largely independent of non-uniform ballast bed conditions. Preferably, the ballast planing shield is arranged between the leading ballast broom and the discharge opening means of the ballast storage bin.

In accordance with another preferred feature, the ballast brooms have differently shaped rotary bodies defined by end faces of the flexible sweeping elements, the rotary body of at least a trailing one of the ballast brooms in the operating direction advantageously having a center portion extending between the rails of the track and outer portions adjacent the center portion, the flexible sweeping elements of the center portion being longer than the flexible sweeping elements of the outer portions. This structure enables the ballast brooms to be used optimally for ballasting track sections which have different types of ties.

BRIEF DESCRIPTION OF THE DRAWING

The above and other objects, advantages and features of the present invention will become more apparent from the following detailed description of certain now preferred embodiments thereof, taken in conjunction with the accompanying drawing wherein.

DETAILED DESCRIPTION OF THE PREFERRED EMBODIMENTS

Figure 1:
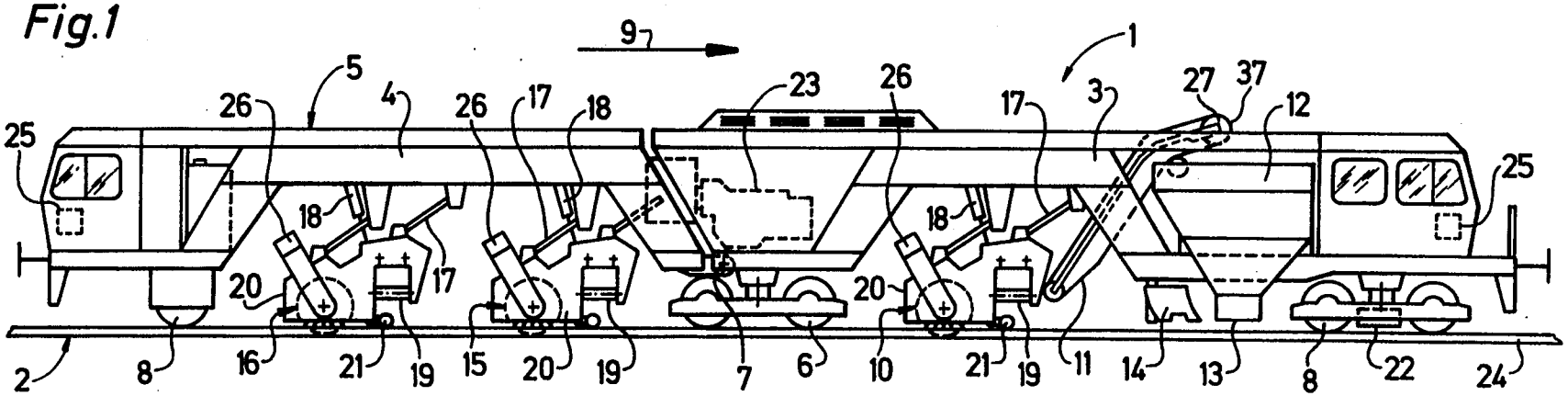
FIG. 1 is a side elevational view of one embodiment of a ballast broom machine according to this invention.

In the drawing, like reference numerals designate like parts operating in a like manner in all figures, which obviates redundancy in the description.

Referring first to FIG. 1, there is shown ballast broom machine 1 for sweeping ballast off track 2 comprising rails 24. The ballast broom machine comprises elongated machine frame 5 extending in a longitudinal direction and supported on the track by undercarriages 6 and 8 for moving the machine frame in an operating direction indicated by arrow 9. Three ballast brooms 10, 15 and 16 are vertically adjustably mounted on machine frame 5. The ballast brooms are spaced from each other in the longitudinal direction and include leading ballast broom 10 in the operating direction. Each ballast broom comprises a rotary shaft 39 extending perpendicularly to the longitudinal direction and flexible sweeping elements 32 projecting radially from the rotary shaft (see FIGS. 3 to 5). Conveyor band 11 is mounted on machine frame 5 and extends in the longitudinal direction, the conveyor band having an input end arranged to receive ballast swept off track 2 by leading ballast broom 10 and discharge end 37 positioned higher than the input end. Ballast storage bin 12 having discharge opening means 13 is arranged on the machine frame below conveyor band discharge end 37 for receiving discharged ballast therefrom. A driven ballast conveyor band 19 is mounted on the machine frame immediately preceding each ballast broom and extends transversely to the longitudinal direction. Each ballast broom has a carrier frame 20 on which the associated transversely extending ballast conveyor band is mounted to form a broom unit therewith.

As shown in the drawing, a respective linkage 17, which preferably is a parallelogram linkage, connects carrier frame 20 of each one of the ballast brooms 10, 15, 16 to machine frame 5 for movement of the ballast brooms in all directions, and flanged wheels 21 support the carrier frame of each ballast broom on rails 24 of track 2. Vertical adjustment drives 18 link the carrier frames of the ballast brooms to the machine frame and, because of the parallelogram linkage, the vertical adjustment of the ballast brooms by drives 18 will not change the horizontal position of the broom units.

Ballast broom machine 1 is moved along track 2 by drive 22 and carries a power source 23 for supplying energy to all operating drives of the machine. Driver's cabs are mounted at each end of machine frame 5 and contain central control panels 25.

The illustrated machine frame is comprised of leading frame part 3 and trailing frame part 4 in the operating direction, the two frame parts being pivotally coupled together by joint 7. Undercarriage 6 is arranged to support the leading frame part and the trailing frame part at joint 7 to form an undercarriage common to both machine frame parts while respective ends of machine frame parts 3, 4 are supported on the track by undercarriages 8, 8. The frame parts have upwardly recessed sections receiving the ballast brooms, and leading ballast broom 10 and ballast storage bin 12 are mounted on leading frame part 3.

The ballast broom machine further comprises ballast planing shield 14 preceding leading ballast broom 10 in the operating direction and vertically adjustably mounted on machine frame 5. As shown in FIG. 1, the ballast planing shield is arranged between the leading ballast broom and the discharge opening means 13 of ballast storage bin 12. Ballast storage bins with adjustable discharge openings are well known.

In operation, the number of ballast brooms used in the sweeping operation may be varied according to the ballasting conditions. While usually all three ballast brooms 10, 15, 16 will be in use by lowering the brooms by means of drives 18 until flanged wheels 21 engage rails 24, it is also possible to keep selected brooms in a raised inoperative position. Particularly if relatively large amounts of ballast are to be swept up, it is advantageous if the lowering of the brooms is staggered so that the rearmost ballast broom 16 is at the lowest level. Once in operating position, the brooms are operated by actuating drives 26 to rotate rotary shafts 39 in a counterclockwise direction. This will cause excess ballast to be swept up to preceding ballast conveyor bands 19, which are driven to convey the swept-up ballast to a selected track shoulder. If drive 27 of inclined conveyor band 11 is actuated, excess ballast swept up by leading ballast broom 10 will be conveyed to discharge end 37 of the conveyor band and discharged into storage bin 12. If a track section requiring additional ballast is reached, discharge openings 13 of the storage bin are opened so that a desired amount of the stored ballast is discharged onto this track section. If accumulations of ballast are encountered, the sweeping operation will be improved if ballast planing shield 14 is lowered so that the accumulations are removed and the ballast is smoothed.

Figure 2:
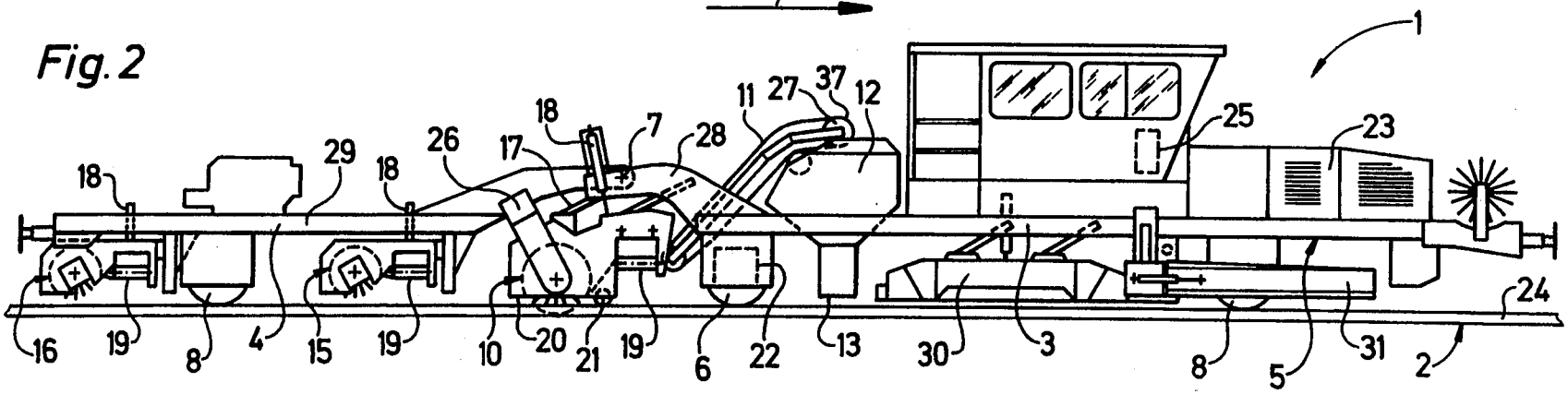
FIG. 2 is a like view showing another embodiment of the machine.

In the ballast broom machine illustrated in FIG. 2, the two ballast brooms 15, 16 trailing leading ballast broom 10 are mounted at a rear end of trailing frame part 4 in the operating direction, and one of the undercarriages 8 is arranged to support the rear end on track 2. Joint 7 pivotally couples a forward end of trailing frame part 4 to a rear end of leading frame part 3 in the operating direction, and the leading frame part rear end projects beyond undercarriage 6 supporting leading frame part 3 on the track, the forward end of the trailing frame part and the rear end of the leading frame part forming upwardly recessed machine frame section 28 receiving leading ballast broom 10.

The embodiment of FIG. 2 further differs from that of FIG. 1 in that leading machine frame part 3 carries a ballast plow arrangement between undercarriages 6, 8 which support this frame part on track 2. The plow arrangement is generally conventional and comprises a center plow 30 and shoulder plows 31 pivoted to the center plow. Ballast Brooms 10, 15, 16 and ballast storage bin 12, when combined with this ballast regulator, are operated in the same manner as described hereinabove in connection with the embodiment of FIG. 1. The plow arrangement makes it possible to handle larger ballast movements before the sweeping operation.

Figure 3:
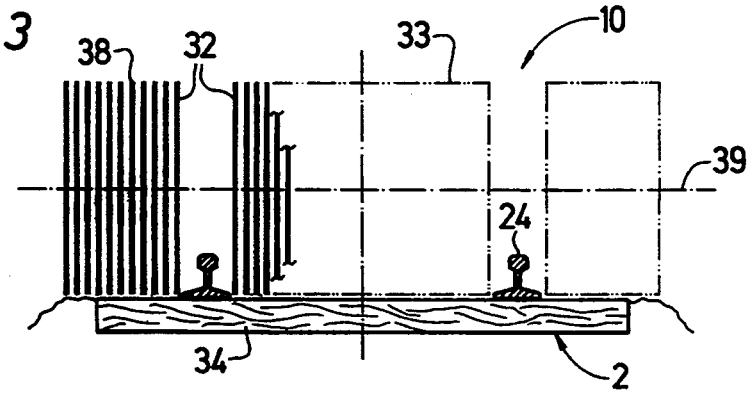
FIGS. 3 to 5 are schematic views showing specific examples of the rotary bodies of the three ballast brooms.
Figure 4:
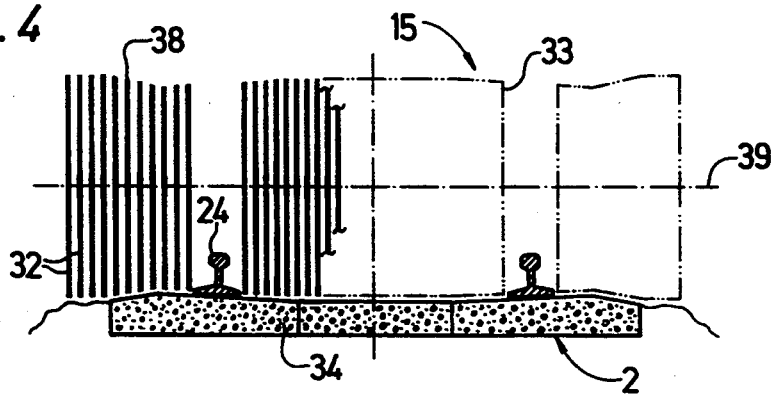
Figure 5:
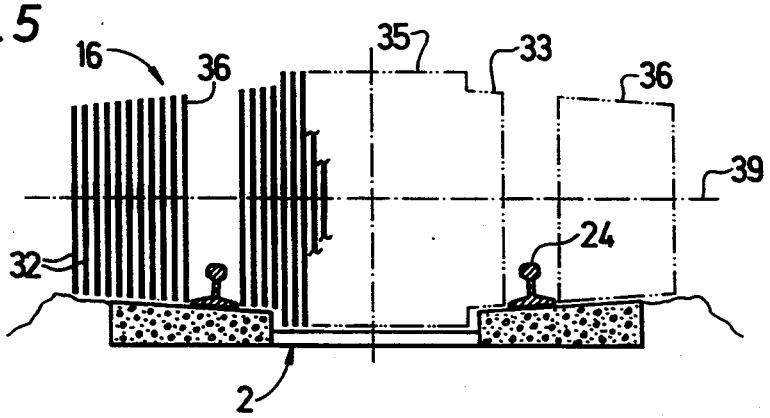

FIGS. 3 to 5 schematically illustrate brooms 10, 15 and 16 having differently shaped rotary bodies 33 defined by end faces 38 of the flexible sweeping elements 32. The rotary bodies and rotary shafts 39 are shown in phantom lines and, for the sake of a clearer showing, the end faces of the sweeping elements are slightly spaced from ties 34. Cylindrical rotary body 33 shown in FIG. 3 is useful primarily for sweeping ballast of wooden ties. Rotary body 33 illustrated in FIG. 4 is shaped to conform to conventional concrete ties. As shown in FIG. 5, rotary body 33 may have a center part 35 and tapered shoulder parts 36 adapted for use with two-block concrete ties wherein respective concrete blocks support track rails 24. The flexible sweeping elements of center part 35 are longer than sweeping elements 32 of the shoulder parts. Particularly in high-speed track sections, this type of broom makes it possible to sweep more ballast out of the cribs between the rails so that the ballast level is lower between the rails at the shoulders.

The rotary bodies of the ballast brooms may be shaped in any desired manner adapted to varying ballasting conditions. For efficient operation in high-speed track sections, it will be advantageous if leading ballast broom 10 has a rotary body of the shape shown in FIG. 3 to enable larger accumulations of ballast to be swept. Rotary body 33 of at least one of the trailing ballast brooms 15, 16 in the operating direction has center portion 35 extending between rails 24 of track 2 and outer portions 36 adjacent the center portion, and flexible sweeping elements 32 of the center portion are longer than the flexible sweeping elements of the outer portions.

If only leading ballast broom 10 and possibly ballast broom 15 has a cylindrical rotary body 33, as shown in FIG. 3, and the last ballast broom 16 is shaped in the manner shown in FIG. 4, the machine can be effectively used in track sections which have wooden ties along parts thereof and concrete ties along other track section parts. In this case, the brooms may be used selectively in the different track section parts.

What is claimed is:

1. A ballast broom machine for sweeping ballast off a track, which comprises (a) an elongated machine frame extending in a longitudinal direction and supported on the track by undercarriages for moving the machine frame in an operating direction, (b) at least three ballast brooms vertically adjustably mounted on the machine frame, the ballast brooms being spaced from each other in the longitudinal direction and including a leading ballast broom in the operating direction, each ballast broom comprising (1) a rotary shaft extending perpendicularly to the longitudinal direction and (2) flexible sweeping elements projecting radially from the rotary shaft, (c) a conveyor band mounted on the machine frame and extending in the longitudinal direction, the conveyor band having (1) an input end arranged to receive ballast swept off the track by the leading ballast broom and (2) a discharge end positioned higher than the input end, (d) a ballast storage bin having discharge opening means and being arranged on the machine frame below the conveyor band discharge end for receiving discharged ballast therefrom, and (e) a ballast conveyor band mounted on the machine frame immediately preceding each one of the ballast brooms and extending transversely to the longitudinal direction.

2. The ballast broom machine of claim 1, further comprising a respective linkage connecting each one of the ballast brooms to the machine frame for movement of the ballast brooms in all directions, and flanged wheels supporting each one of the ballast brooms on the track.

3. The ballast broom machine of claim 2, wherein the linkage is a parallelogram linkage.

4. The ballast broom machine of claim 1, wherein the machine frame is comprised of a leading frame part and a trailing frame part in the operating direction, the two frame parts being pivotally coupled together by a joint.

5. The ballast broom machine of claim 4, wherein one of the undercarriages is arranged to support the leading frame part and the trailing frame part at said joint.

6. The ballast broom machine of claim 4, wherein the frame parts have upwardly recessed sections receiving the ballast brooms, the leading ballast broom and the ballast storage bin being mounted on the leading frame part.

7. The ballast broom machine of claim 4, wherein the two ballast brooms trailing the leading ballast broom are mounted at a rear end of the trailing frame part in the operating direction, one of the undercarriages is arranged to support the rear end on the track, the joint pivotally couples a forward end of the trailing frame part to a rear end of the leading frame part in the operating direction, the leading frame part rear end projecting beyond another one of the undercarriages supporting the leading frame part on the track, the forward end of the trailing frame part and the rear end of the leading frame part forming an upwardly recessed machine frame section receiving the leading ballast broom.

8. The ballast broom machine of claim 1, further comprising a ballast planing shield preceding the leading ballast broom in the operating direction and vertically adjustably mounted on the machine frame.

9. The ballast broom machine of claim 8, wherein the ballast planing shield is arranged between the leading ballast broom and the discharge opening means of the ballast storage bin.

10. The ballast broom machine of claim 1, wherein the ballast brooms have differently shaped rotary bodies defined by end faces of the flexible sweeping elements.

11. The ballast broom machine of claim 10, wherein the rotary body of at least a trailing one of the ballast brooms in the operating direction has a center portion extending between the rails of the track and outer portions adjacent the center portion, the flexible sweeping elements of the center portion being longer than the flexible sweeping elements of the outer portions.

* * * * *